US007240859B2

(12) United States Patent
Ricco et al.

(10) Patent No.: US 7,240,859 B2
(45) Date of Patent: Jul. 10, 2007

(54) FUEL-INJECTION SYSTEM FOR AN INTERNAL-COMBUSTION ENGINE AND CORRESPONDING METHOD FOR CONTROLLING FUEL INJECTION

(75) Inventors: Mario Ricco, Casamassima (IT); Sisto Luigi De Matthaeis, Valenzano (IT); Antonio Gravina, Valenzano (IT); Sergio Stucchi, Valenzano (IT)

(73) Assignee: CRF Societa Consortile Per Azioni, Orbassano, Strada Torino (IT)

( * ) Notice: Subject to any disclaimer, the term of this patent is extended or adjusted under 35 U.S.C. 154(b) by 0 days.

(21) Appl. No.: 11/391,443

(22) Filed: Mar. 29, 2006

(65) Prior Publication Data

US 2007/0131789 A1 Jun. 14, 2007

(30) Foreign Application Priority Data

Dec. 12, 2005 (EP) ..... 05425881

(51) Int. Cl.
*B05B 1/30* (2006.01)

(52) U.S. Cl. ..... 239/585.1; 239/585.4; 239/585.5; 239/900; 239/5; 123/478; 123/480

(58) Field of Classification Search ..... 239/585.1, 239/533.3, 533.8, 533.2, 88, 89, 95; 123/478, 123/480, 490; 361/152, 154, 155
See application file for complete search history.

(56) References Cited

U.S. PATENT DOCUMENTS 5,526,791 A * 6/1996 Timmer et al. ..... 123/467
6,059,204 A * 5/2000 Augustin ..... 239/533.4
6,543,706 B1 * 4/2003 Hutchings et al. ..... 239/533.3

FOREIGN PATENT DOCUMENTS

| | | | |
|---|---|---|---|
| DE | 196 36 088 | A1 | 3/1998 |
| DE | 198 09 001 | A1 | 9/1998 |
| DE | 100 64 790 | A1 | 6/2001 |
| DE | 100 84 656 | C2 | 12/2003 |
| EP | 0 570 986 | A2 | 11/1993 |
| EP | 0 582 993 | A1 | 2/1994 |
| EP | 1 016 783 | A2 | 7/2000 |
| WO | WO 00/63550 | A1 | 10/2000 |
| WO | WO 01/27465 | A1 | 4/2001 |
| WO | WO 03/081018 | A1 | 10/2003 |

* cited by examiner

*Primary Examiner*—Dinh Q. Nguyen
(74) *Attorney, Agent, or Firm*—Sughrue Mion, PLLC

(57) ABSTRACT

A fuel-injection system in an internal-combustion engine is provided with an electroinjector (1) comprising an injection nozzle (5), and a needle (7) mobile along an opening stroke and a closing stroke for opening/closing the nozzle (5) under the control of an electroactuator device (8). The opening stroke of the needle (7) is controlled by a rod (14) pushed by the pressure of the fuel in a control chamber (15), in such a way as to keep the needle (7) normally in the position for closing the nozzle (5). The control chamber (15) is equipped with an inlet duct (18) having a pre-set diameter ($D_4$) and with an outlet passage (24) having a diameter ($D_5$) and controlled by a control valve (16). The method for controlling fuel injection comprises the steps of choosing the ratio ($D_5/D_4$) of the aforesaid diameters so as to determine a certain rate of displacement of the needle (7), and issuing to the device (8) a first electrical command ($C_1$) and a second electrical command ($C_2$) sufficiently close to one another to displace the needle (7) with a profile of motion (P) without any discontinuities in time.

30 Claims, 5 Drawing Sheets

FUEL-INJECTION SYSTEM FOR AN INTERNAL-COMBUSTION ENGINE AND CORRESPONDING METHOD FOR CONTROLLING FUEL INJECTION

The present invention relates to a fuel-injection system for an internal-combustion engine and to the corresponding method for controlling fuel injection.

In the engine sector, there is felt the need to make injections of fuel in which the instantaneous flow rate of injected fuel as a function of time presents an evolution comprising at least two stretches with levels that are substantially constant and different from one another; i.e., it can be represented schematically with a curve of the stepwise type. In particular, there is felt the need to inject an instantaneous flow F of fuel having an evolution in time T similar to the one represented by the curve of FIG. 9, in which there is present a first flow-rate level $L_1$ and a subsequent second level $L_2$, in general higher than the first one.

In an endeavour to obtain such a flow-rate curve, it is known to provide injectors of a dedicated type, in which opening of the injection nozzle is caused by the lifting of two mobile open/close pins or needles, co-operating with respective springs, or else by the lifting of a single open/close needle co-operating with two coaxial springs. The two springs are differently preloaded with respect to one another, and/or present characteristics of force/displacement that are different from one another, for opening the nozzle with lifts such as to approximate the required flow-rate curve.

The known solutions just described are far from altogether satisfactory in so far as it is somewhat complex to calibrate the springs in an optimal way to obtain a first flow-rate level or step $L_1$ lower than the level $L_2$ of the maximum flow-rate from the nozzle and, hence, to approximate a flow-rate curve like the one of FIG. 9. Furthermore, given the same pressure of supply of the fuel, once the law of lifting of the needles, and hence the law of opening of the nozzle, i.e. the curve of the flow-rate of injected fuel, has been established, said law cannot be modified according to variations of the operating conditions of the engine. Finally, it is somewhat difficult to obtain injectors with a profile of flow-rate of injected fuel that is constant for the entire production.

Known from the document FR 2 761 113 A is an injection system comprising a control unit designed to control the injector in such a way that, for each cycle, a pre-injection is first performed, followed by a main injection, which starts before the pre-injection has ended. This system presents the disadvantage of allowing situations in which it is not possible to obtain a pre-injection.

The aim of the present invention is to provide an injection system for an internal-combustion engine and a method for controlling injection of fuel which will enable the drawbacks set forth above to be solved in a simple and inexpensive way.

The above aim is achieved by a fuel-injection system for an internal-combustion engine, as defined in Claim 1, and by a method for controlling fuel injection, as defined in Claim 14.

For a better understanding of the invention, a preferred embodiment is now described, purely by way of non-limiting example, with reference to the attached drawings, wherein.

Figure 1:
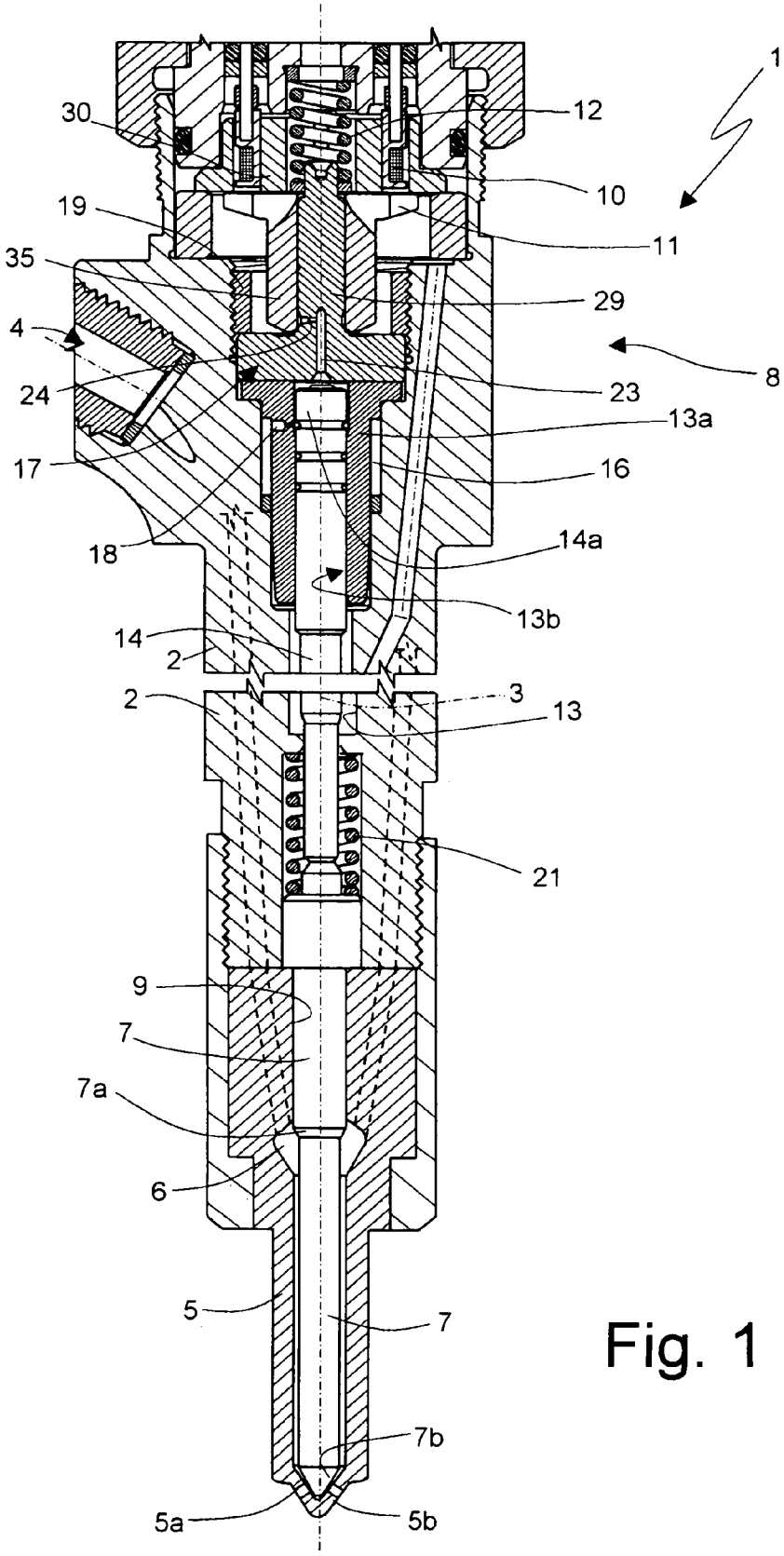
FIG. 1 is a cross-sectional view, with parts removed for reasons of clarity, of an electroinjector for the injection system according to the invention.

Designated as a whole by the reference number 1 in FIG. 1 is an electroinjector (partially illustrated) of an internal-combustion engine, in particular a diesel engine. The electroinjector 1 comprises a shell 2, which extends along a longitudinal axis 3, and has a side inlet 4, designed to be connected to a common-rail fuel-supply system. The system is controlled by an electrical control unit according to the usual conditions of operation of the engine.

The electroinjector 1 terminates with an atomizer, which comprises a nozzle 5 communicating with the inlet 4 through an injection chamber 6. The nozzle 5 has a conical tip 5*b* provided with holes 5*a* for injection of the fuel into a combustion chamber of the engine. The nozzle 5 is normally held closed by an open/close needle 7, having a conical tip 7*a* designed to engage the conical tip 5*b*. The needle 7 is mobile in an axial seat 9 for opening/closing the nozzle 5 under the control of an electroactuator device 8, which will be described in greater detail hereinafter. In particular, the conical tip 7*b* of the needle 7, by engaging the conical tip 5*b* of the nozzle 5, closes the holes 5*a*.

Figure 2:
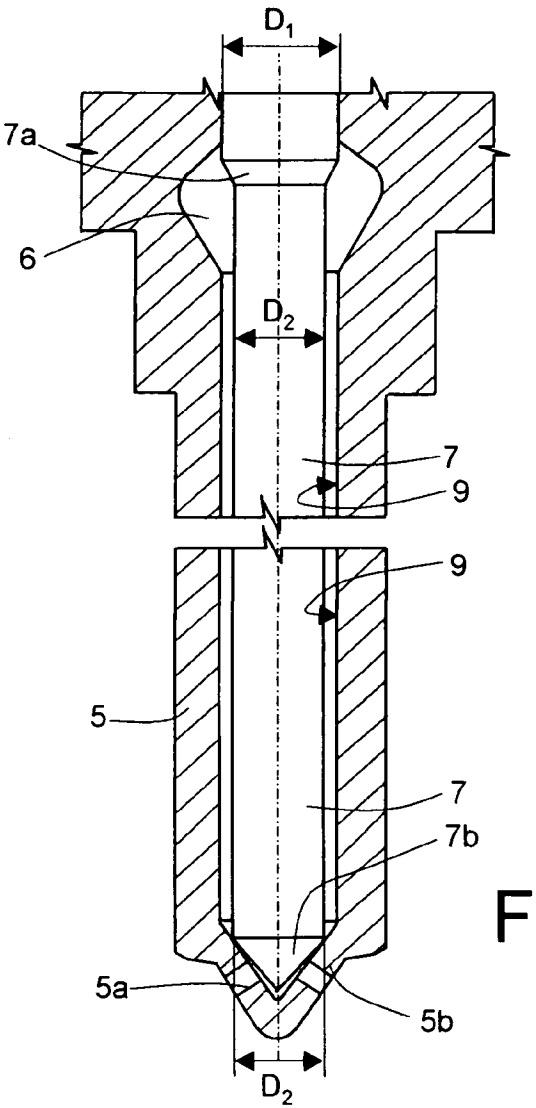
FIG. 2 illustrates a detail of FIG. 1, at an enlarged scale.

The needle 7 has an active surface subject to the pressure of the fuel in the chamber 6, said active surface being formed by a shoulder or annular surface 7*a* (FIG. 2) and possibly by a portion of surface of the conical tip 7*b* delimited by a sealing circle against the conical tip 5*b* of the nozzle 5. The active surface has an external diameter $D_1$ and an internal diameter $D_2$. In the case of FIG. 2, the diameter $D_2$ coincides with the internal diameter of the shoulder 7*a*.

The electroinjector 1 carries out metering of the fuel by modulating opening of the needle 7 of the atomizer in time as a function of the supply pressure of the electroinjector 1 itself, i.e. of the pressure of the fuel at the inlet 4 (FIG. 1), as will be described in greater detail hereinafter. The device 8 is preferably of the type comprising an electromagnet 10, an armature 11 axially slidable in the shell 2 under the action of the electromagnet 10, and a preloaded spring 12, which acts on the armature 11 in a direction opposite to that of attraction exerted by the electromagnet 10.

The shell 2 has an axial seat 13, made as a prolongation of the seat 9, in which a rod 14 is housed, engaged with the needle 7 for transmitting to the latter an axial thrust under the action of the pressure of the fuel. Set between the needle 7 and a shoulder of the seat 13 is another spring 21, which contributes to keeping the needle 7 in the position for closing the nozzle 5. In particular, fixed in an intermediate stretch of the seat 13 is a metering solenoid valve 16, comprising a valve body 13*a*, which is coupled to the shell 2 in a fixed and fluid-tight position. The valve body 13*a* has an axial seat 13*b*, in which a top portion 14*a* of the rod 14, having a diameter $D_3$, slides in a fluid-tight way. The diameter $D_3$ of the top cylindrical portion 14*a* is larger than the external diameter $D_1$ of the active surface 7*a* of the needle 7. In addition, the end of the portion 14*a* of the rod 14 defines, with the end portion of the seat 13*b*, a control chamber 15 of the rod 14, associated to the metering solenoid valve 16.

Figure 3:
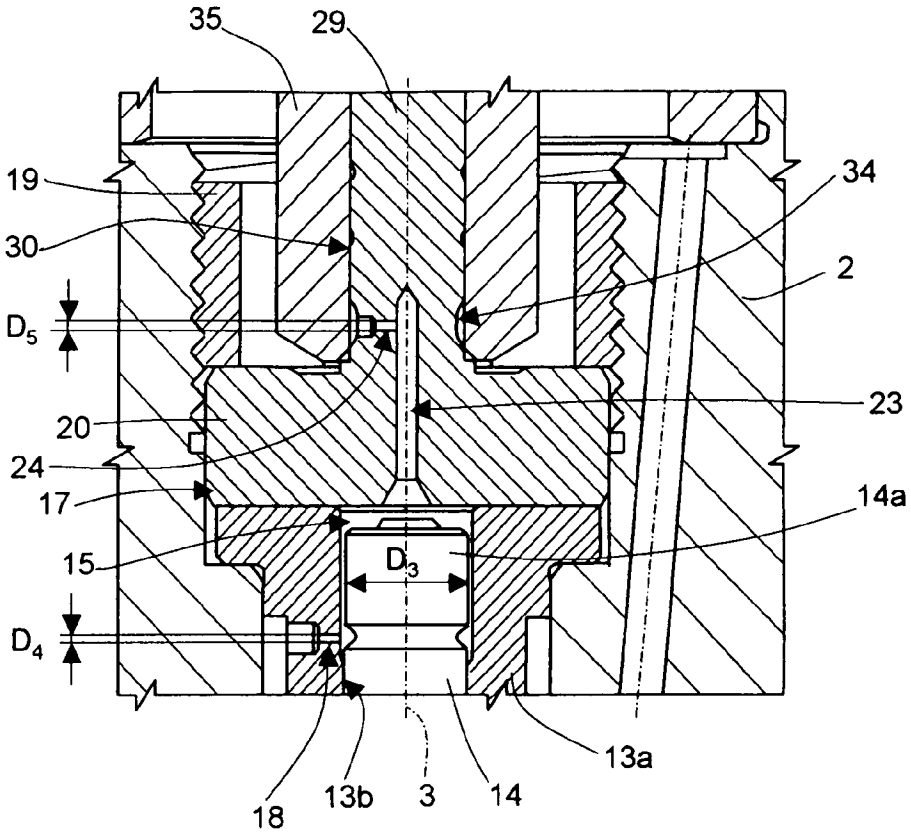
FIG. 3 illustrates another detail of FIG. 1, at another scale of enlargement.

The control chamber 15 communicates permanently with the inlet 4, through a calibrated inlet duct 18 (FIG. 3) having a diameter $D_4$, which is made in the body 13*a* and is designed to receive the fuel under pressure. Fixed on the body 13*a*, under the action of a ring nut 19, is a distribution body 17, which has a flange 20 made of a single piece with a stem or pin 29. This is delimited by a cylindrical side surface 30, on which an annular chamber 34 is dug. The pin 29 has an axial duct 23 in communication with the control chamber 15 and with a calibrated radial passage 24, which gives out into the chamber 34. Alternatively, the axial duct 23 can be in communication with at least two radial passages set symmetrically with respect to the axis 3.

The calibrated radial passage 24 has a diameter $D_5$ and is designed to be opened/closed by an open/close element defined by a sleeve 35 fixed to the armature 11 of the electromagnet 10. The sleeve 35 is fitted on the pin 29 and is axially slidable under the action of the electromagnet 10 for varying the pressure present in the chamber 15, and hence for opening/closing the nozzle 5.

Normally, the electromagnet 10 is de-energized, and the spring 12 keeps the sleeve 35 of the armature 11 in contact with the flange 20 of the distributor body 17, so as to close the annular chamber 34. In the control chamber 15 there is fuel under pressure, as in the injection chamber 6 and in the annular chamber 34 itself. The action of the pressure in the control chamber 15 acting on the rod 14, assisted by the action of the spring 21, prevails over the action of the pressure on the annular surface 7*a* so that the needle 7 keeps the nozzle 5 closed.

When the electromagnet 10 is energized, this attracts the armature 11, so that the sleeve 35 opens the chamber 34. The fuel of the control chamber 15 is discharged through the radial passage 24, and the pressure of the fuel in the injection chamber 6 pushes the needle 7 along the opening stroke upwards, opening the nozzle 5 and thus determining injection of the fuel. When the electromagnet 10 is de-energized, the spring 12 brings the armature 11 back downwards, so that the sleeve 35 recloses the annular chamber 34, and the fuel entering from the inlet duct 18 restores the pressure of the control chamber 15. The action of said pressure on the surface of the portion 14*a* of the rod 14, assisted by the action of the spring 21, prevails again over the pressure of the fuel on the annular surface 7*a*, so that the needle 7 performs its stroke for closing of the nozzle 5.

It is evident that, when the sleeve 35 closes the chamber 34, it is subjected to a zero resultant of pressure of the fuel along the axis 3, with consequent advantages from the standpoint of stability of the dynamic behaviour of the mobile parts of the electroinjector 1. In particular, the displacement of the needle 7 along the opening stroke and along the closing stroke is practically constant between one injection and the next, in response to a given electrical command sent to the device 8.

In other words, it is possible to correlate the position of the needle 7 in a biunique and repeatable way with the electrical commands sent to the device 8. The position of the needle 7 along the opening and closing strokes, in response to an electrical command, can be obtained by means of theoretical calculation, as a function of constructional parameters of the electroinjector 1 (for example, the diameters $D_1$ and $D_2$ of the needle 7, $D_3$ of the rod 14, $D_4$ of the inlet duct 18 and $D_5$ of the outlet passage 24 of the control chamber 15) and as a function of known operating parameters (for example, pressure of supply of the fuel to the inlet 4). At the same time, the section of opening of the nozzle 5, and hence the evolution of the instantaneous flow rate of the fuel can be determined in a unique way as a function of the axial displacement of the needle 7, in particular on the basis of the dimensions of the passages of the nozzle 5 itself and on the basis of the supply pressure of the fuel.

In particular, the law of axial displacement of the needle 7 depends not only upon the spring 21 but also upon the ratio $D_3/D_1$ between the diameter $D_3$ of the portion 14*a* and the external diameter $D_1$ of the active surface, i.e. of the shoulder 7*a*, and upon the ratio $D_1/D_2$ between the external diameter $D_1$ and the internal diameter $D_2$ of the active surface, which in the case under examination coincides with that of the shoulder 7*a*. The value of said ratios renders the injector more or less sensitive to the evolution of the pressure in the control chamber 15. As the ratio $D_3/D_1$ tends to unity and/or as the ratio $D_1/D_2$ increases, the displacement of the needle 7 becomes very sensitive to said pressure, so that a small drop in pressure in the control chamber 15 brings about opening of the nozzle 5. Preferably, the ratio $D_3/D_1$ can be comprised between 1.05 and 1.2, and the ratio $D_1/D_2$ is comprised between 1.85 and 2.35, whilst the diameter $D_1$ of the needle 7 can be comprised between 3.2 and 4.8 mm.

In turn, the pair of values of the diameters $D_4$, $D_5$ of the inlet duct 18 and of the radial outlet passage 24 affects the curve of the pressure of the fuel in the control chamber 15, both during opening of the solenoid valve 16 and during the subsequent closing. As the ratio $D_5/D_4$ increases during the opening stroke of the sleeve 35, the pressure in the control chamber 15 decreases more rapidly, thus reducing the transient of opening of the needle 7. Furthermore, as the ratio $D_5/D_4$ increases, during the closing stroke of the sleeve 35, the pressure in the control chamber 15 increases more slowly, thus causing the delay in closing of the needle 7. Preferably said ratio $D_5/D_4$ is chosen between the values 0.7 and 1.4, whilst the diameter $D_5$ of the radial passage 24 can be chosen between 0.22 and 0.35 mm.

Figure 4:
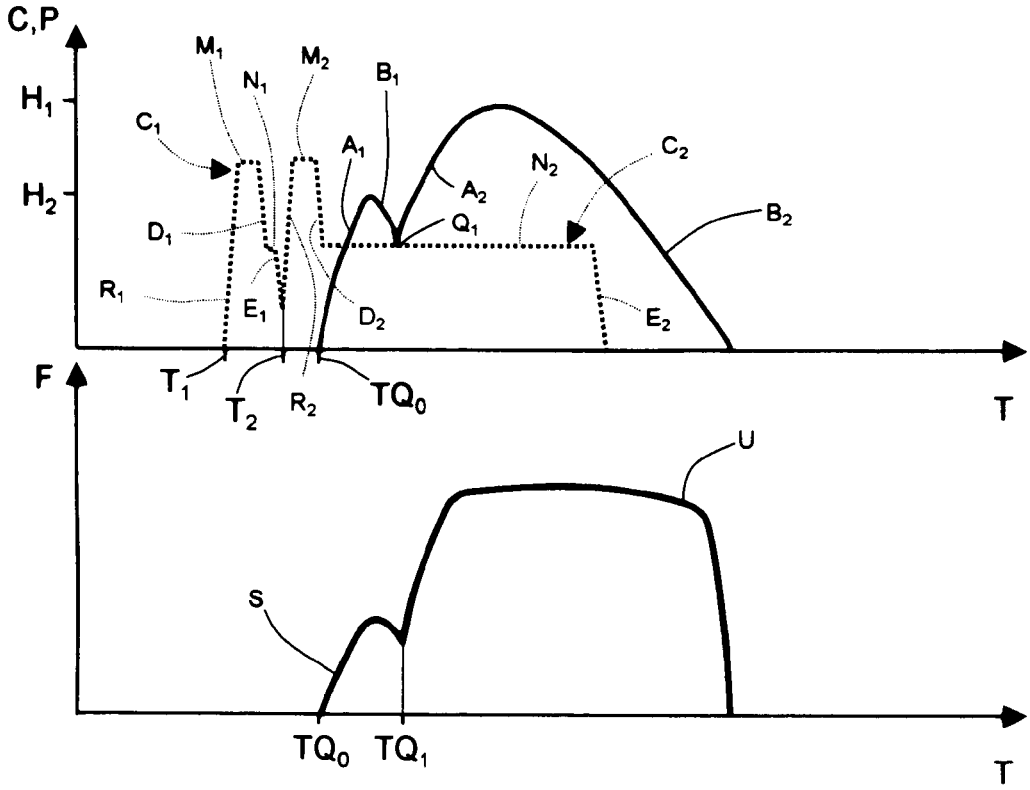
FIGS. 4 to 6 are graphs regarding the operation of an electroinjector according to preferred embodiments of the invention.
Figure 5:
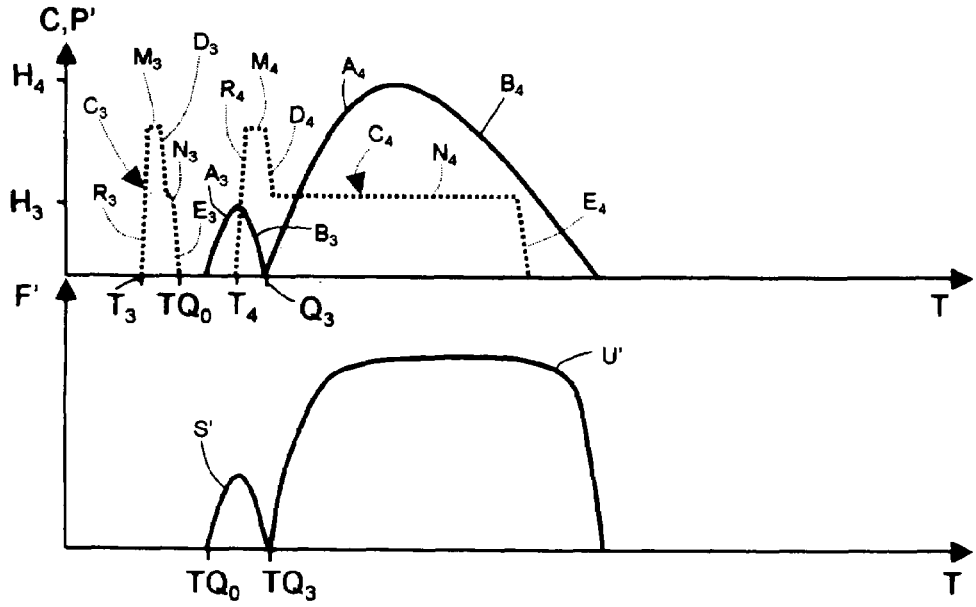
Figure 6:
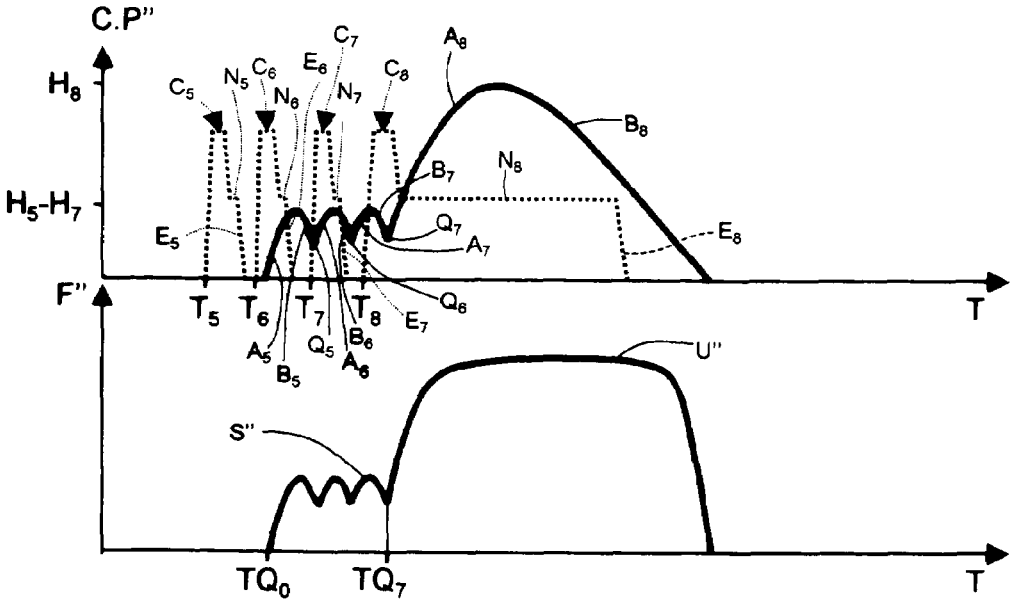

FIGS. 4-6 show each one a top graph with a dashed-line curve, which represents, as a function of time T, the patterns C of the electrical commands sent to the device 8, and with a solid-line curve, which represents the profile or evolution P of the motion, i.e. of the axial position assumed by the needle 7, in response to said commands, where the "zero" ordinate represents the point in which the nozzle 5 is closed. FIGS. 4-6 also each show a bottom graph, which represents, as a function of time T, the evolution F of the instantaneous flow-rate of fuel injected through the nozzle 5 and caused by the displacement of the needle 7, shown in the corresponding top graph.

In FIGS. 4-6, associated to the portions of electrical commands C and of the displacements A and B of the needle 7 are respective number subscripts. For reasons of clarity, by the term "command" is meant, in the present description and in the annexed claims, an electrical signal having an evolution C, which initially has a rising edge or ramp R with a relatively rapid initial increase. In the examples illustrated, the device 8 receives electrical-current signals, the evolution C of which, after the rising edge R, presents a stretch M of holding around a maximum value, a stretch D of decrease down to an intermediate value, a stretch N of holding around said intermediate value, and a stretch E of final decrease.

According to the method of the present invention, to obtain a fuel injection, supplied to the device 8 is at least a first and a second electrical command (FIGS. 4-6), which are sufficiently close to one another as to displace the needle 7 with a profile P of motion without any discontinuities in time. Said electrical commands cause the needle 7 to perform a first opening displacement and a second opening displacement, or lift, which are defined in the profile P by respective stretches A, increase up to relative-maximum values H, and are followed by respective closing displacements defined by decreasing stretches B of the profile P.

With reference to FIG. 4, the control unit can be prearranged for actuating the electromagnet 10 with at least a first electrical command $C_1$ and a second electrical command $C_2$, such as to cause the needle 7 to perform a first opening displacement $A_1$ and a second opening displacement $A_2$, for example to control, respectively, a pre-injection of fuel and a main injection, the latter depending upon the operating conditions of the engine.

In particular, at the instant $T_1$ the first command $C_1$ is issued, the evolution of which increases with the ramp $R_1$, then remains substantially constant for a short stretch $M_1$, then decreases along the stretch $D_1$, presents a stretch $N_1$ that is substantially constant, and finally decreases with a stretch $E_1$. The evolution of the command $C_1$ causes displacement of the needle 7 starting from an instant $TQ_0$, with $TQ_0>T_1$ on account of the delay in the response of the device 8, with a profile P comprising a stretch $A_1$, which increases up to a value $H_1$, and a decreasing stretch $B_1$. On account of the short duration of the stretch $N_1$ of the command $C_1$, the lift $H_1$ of the needle 7 is limited and has the purpose of controlling a pre-injection of a fixed amount of fuel.

The second command $C_2$ is issued at an instant $T_2$ such as to start the second lift, i.e. the stretch $A_2$, in a point $Q_1$ of the stretch $B_1$ before the needle 7 has reached the position of end of closing stroke of the nozzle 5. In particular, the instant $T_2$ is smaller than the theoretical instant in which the first command represented by the curve $C_1$, which prolongs the stretch $E_1$, would reach a zero value. The curve $C_2$ has a stretch $N_2$ of duration longer than the stretch $N_1$, which depends in a known way upon the operating conditions of the engine, so that the lift of the needle 7 reaches a value $H_2$ higher than $H_1$, causing a degree or cross-section of opening of the nozzle 5, and/or a duration of said opening, greater than that reached at the end of the stretch $A_1$. There then follows a closing displacement defined by the stretch $B_2$, up to complete closing of the nozzle 5, after which the needle 7 remains stationary until the subsequent injection.

The time interval $T_1$-$TQ_0$ is the delay with which the needle 7 starts to move upwards and depends in the first place upon the ratio $D_5/D_4$ between the diameter $D_5$ of the outlet passage 24 of the control chamber 15 and the diameter $D_4$ of the inlet duct 18, which determines the rate of reduction of the pressure in the control chamber 15. Said delay depends not only upon the preloading of the spring 21 (see also FIGS. 1-3) but also upon the ratio of the surface normal to the axis 3 of the end of the portion 14*a* of the rod 14, defined by the diameter $D_3$, and of the active surface of the needle 7, defined by the diameter $D_1$ and by the diameter $D_2$, which determines the resultant of the pressures on the needle 7. In particular, the ratio of the surfaces on which the pressure of the fuel acts is defined by the combination of the ratio $D_3/D_1$ between the diameter $D_3$ of the portion 14*a* of the rod 14 and the external diameter $D_1$ of the shoulder 7*a* and the ratio $D_1/D_2$ between the external diameter $D_1$ and the internal diameter $D_2$ of the active surface of the needle 7. The two ratios of the diameters are chosen so as to contribute to determining the rate of displacement of the needle 7.

Figure 9:
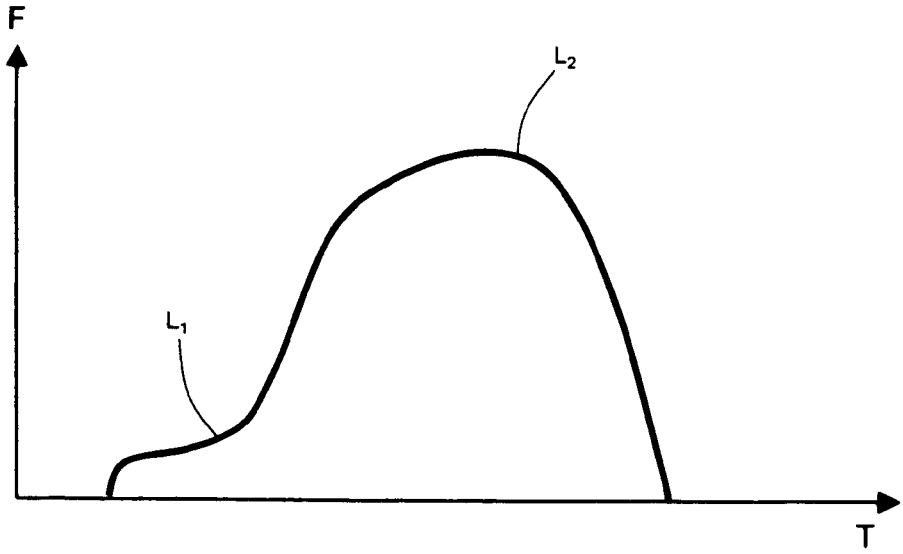
FIG. 9 illustrates a desired curve of instantaneous flow-rate of fuel during an injection.

The curve F of the instantaneous flow rate obtained approximates in a satisfactory manner the desired curve of instantaneous flow rate illustrated in FIG. 9, in so far as it presents two consecutive portions S and U (represented by a solid line in FIG. 4), without any discontinuities in time, i.e. without any pauses or dwell times, between the stretch $B_1$ and the stretch $A_2$. The two portions S and U present respective maximum levels $H_1$ and $H_2$ that are different from one another, and hence also respective mean levels that are different from one another, which approximate the levels $L_1$ and $L_2$, respectively, of FIG. 9. The instant in which the portion S terminates and the portion U starts corresponds to the time abscissa $TQ_1$ of the point $Q_1$.

The time interval $TQ_0$-$TQ_1$ depends also upon the ratio $D_3/D_1$ between the diameters of the aforesaid surfaces of the rod 14 and of the needle 7 and upon the ratio $D_1/D_2$ between the external diameter $D_1$ and the internal diameter $D_2$ of the active surface of the needle 7, and upon the ratio of the diameters $D_5/D_4$. As the ratio $D_3/D_1$ decreases and/or as the ratio $D_1/D_2$ increases, both the time interval $TQ_0$-$TQ_1$ and the displacements $H_1$ and $H_2$ increase because the needle 7 is more ready to open the nozzle 5 and slower in closing it, on account of the resultant of the pressures acting thereon. In turn, as the ratio of the diameters $D_5/D_4$ increases, both the time interval $TQ_0$-$TQ_1$ and the displacements $H_1$ and $H_2$ increase because the reduction of the pressure in the control chamber 15 is faster, so that the needle 7 is more ready to open the nozzle 5 and slower in closing it on account of the resultant of the pressures acting thereon.

Figure 7:
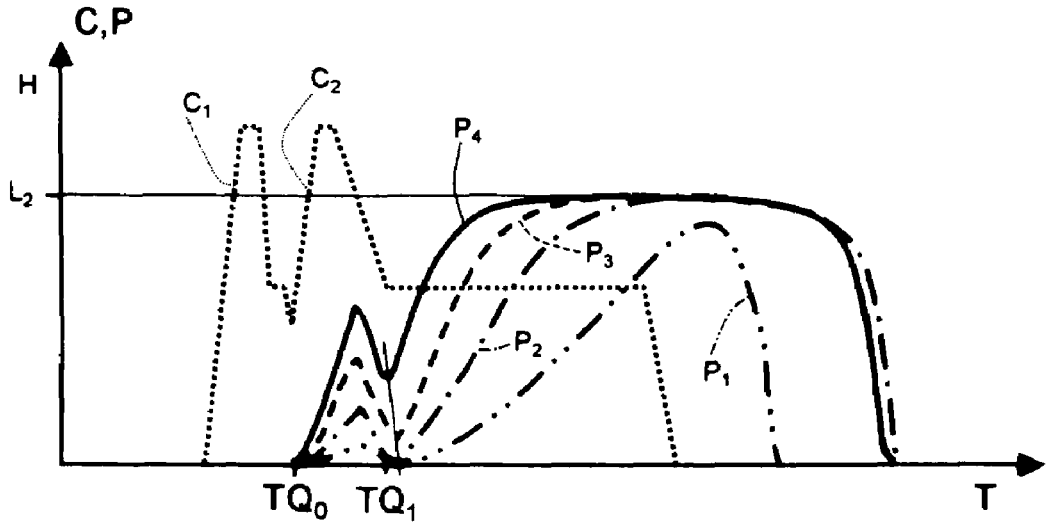
FIGS. 7 and 8 illustrate two graphs indicating the variation of the flow-rate of the injector as two parameters of the electroinjector vary.

FIG. 7 shows with dashed lines the curves of the two commands $C_1$ and $C_2$, and with different lines a series of curves of the instantaneous flow-rate of the electroinjector 1 detected experimentally, given the same time interval between issuing of the two commands $C_1$ and $C_2$, as the diameter $D_5$ varies from 0.22 mm for the curve $P_1$ to 0.35 mm for the curve $P_4$. It may be noted how, as the diameter $D_5$ increases, the time interval $TQ_0$-$TQ_1$ decreases and the displacements $H_1$ and $H_2$ increase.

Figure 8:
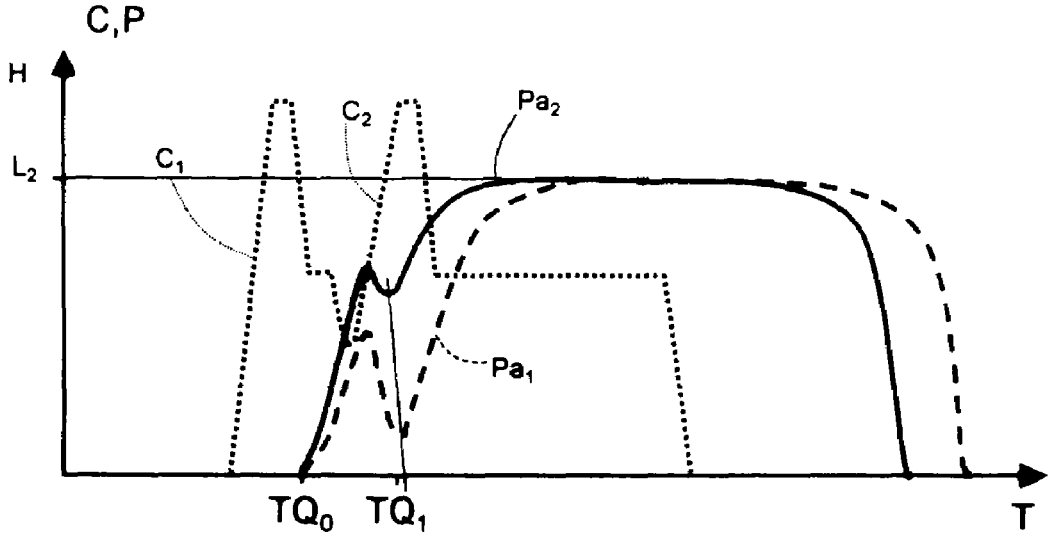

FIG. 8 also shows with dashed lines the curves of the two commands $C_1$ and $C_2$, and with different lines two curves of the instantaneous flow rate of the electroinjector 1, detected experimentally, as the ratio $D_3/D_1$ between the diameter of the portion 14*a* of the rod 14 and the diameter of the needle 7 varies from 1.05 for the curve $Pa_1$ to 1.2 for the curve $Pa_2$. It may be noted that also in this case the time interval $TQ_0$-$TQ_1$ decreases.

From FIGS. 7 and 8 it is moreover clear that both as the diameter $D_5$ (FIG. 7) increases and as the ratio $D_3/D_1$ (FIG. 8) increases there is an increase in the delay in closing of the stretch $B_2$ of the curves P. Finally, it may be noted that the level $L_2$ of the instantaneous flow-rate F reaches in general a maximum that is independent of the diameter $D_5$ (FIG. 7) and of the ratio $D_3/D_1$ (FIG. 8).

According to the example of FIG. 5, the device 8 receives two electrical commands in succession, which are designated by the subscripts or reference numbers 3 and 4, respectively, and which cause the needle 7 to be displaced with a profile P' of motion indicated by a solid line, which comprises a displacement $A_3$ for determining the pre-injection and a displacement $A_4$ for determining the main injection. The profile P' is again without any discontinuities in time between the stretch $B_3$ and the stretch $A_4$, but is in a limit condition; i.e. the second electrical command is supplied at an instant $T_4$ such as to start the second lift $A_4$ in a final point $Q_3$ of the stretch $B_3$, that is when the needle 7 has just reached the position of end-of-closing stroke.

In particular, the instant $T_4$ is greater than the instant in which the stretch $E_3$ of the curve $C_3$ goes to zero. Albeit in a limit condition, the curve F' of the instantaneous flow rate obtained comprises two consecutive portions S' and U', which present respective maximum levels that are different from one another, and hence respective mean levels that are different from one another and once again approximate in a satisfactory way, respectively, the levels $L_1$ and $L_2$ of the desired curve of the instantaneous flow rate of FIG. 9. It is evident that the instant in which the portion S' terminates and the portion U' starts corresponds to the time abscissa $TQ_3$ of the point $Q_3$.

According to the example of FIG. 6, the device 8 receives four electrical commands in succession, which are designated, respectively, by the reference numbers or subscripts 5-8, and are supplied in respective instants $T_5$-$T_8$ sufficiently close to one another as to displace the needle 7 with a profile P" of motion that is again without any discontinuities in time. The instants $T_6$-$T_8$ are now greater than the instants in which the stretches $E_5$-$E_7$, respectively, go to zero. In a way similar to the example of FIG. 4, the stretches $A_6$-$A_8$ start in respective points $Q_5$-$Q_7$ of the stretches $B_5$-$B_7$, in which the needle 7 has not yet reached the position of end-of-closing stroke of the nozzle 5.

The values $H_5$-$H_7$ (relative maxima) reached by the needle 7 at the end of the first three lifts are substantially the same as one another so that the relative-maximum sections of opening of the nozzle 5 are substantially equal. In this case, the pre-injection is governed by the three electrical commands $C_5$-$C_7$. The value $H_8$ reached at the end of the fourth and last lift (stretch $A_8$) is higher and causes a greater degree or section of opening to determine the main injection, in so far as the stretch $N_8$ has a longer duration than the stretches $N_5$-$N_7$.

There is consequently obtained a curve F" of flow-rate which approximates the desired flow-rate curve of FIG. 9 in a better way, in so far as it approaches more closely a stepwise curve. In particular, the curve F" comprises, up to an instant $TQ_7$ coinciding with the time abscissa of the point $Q_7$, a portion S" which has three "peaks" and approximates the level $L_1$ of the curve of FIG. 9 and, after the instant $TQ_7$, a portion U", which has mean and maximum levels higher than those of the portion S" and which approximates the level $L_2$ of the curve of FIG. 9.

According to variants (not illustrated), it is possible to approximate curves of instantaneous flow-rate of the stepwise type, in which more than two levels are present, by causing the needle 7 to be displaced with more than two consecutive lifts up to values H that are different from one another, and/or to approximate curves of instantaneous flow-rate in which a level $L_1$ is followed by a low level $L_2$, contrary to the levels $L_1$ and $L_2$ illustrated in FIG. 9, by issuing electrical commands of appropriate durations and amplitudes.

From the foregoing description, there clearly emerges the method for controlling fuel injection in an internal-combustion engine, in which an electroinjector 1 comprises:

an electroactuator device 8; and an atomizer comprising an injection nozzle 5, and a needle 7 that is mobile along an opening stroke and a closing stroke for opening/closing the nozzle 5 under the control of the device 8;

the electroinjector 1 performing the metering of the fuel by modulating in time opening of the needle 7 controlled by a rod 14, which is pushed by the pressure of the fuel in a control chamber 15 so as to keep the needle 7 in the closing position for the nozzle 5; and the control chamber 15 being equipped with a calibrated inlet duct 18 having a pre-set diameter $D_4$ and with an outlet passage 24 having a diameter $D_5$ that is controlled by a metering valve 16.

The method for controlling fuel injection is characterized in that:

the ratio $D_5/D_4$ between the diameter of the outlet passage 24 and the diameter of the inlet duct 18 is chosen so as to determine a certain rate of displacement of the needle 7;

issued to the device 8 is at least one first electrical command $C_1$; $C_3$; $C_5$-$C_7$ and one second electrical command $C_2$; $C_4$; $C_8$ to control corresponding displacements of opening of the needle 7; and the first electrical command $C_1$; $C_3$; $C_5$-$C_7$ and the second electrical command $C_2$; $C_4$; $C_8$ are timed in a way sufficiently close to one another as to cause a displacement of the needle 7 with a profile of motion P without any discontinuities in time.

In addition, according to the method of the present invention for at least one injection, at least one of the following quantities is determined as a function of operating parameters of the engine:

duration of at least one between said first electrical command $C_1$; $C_3$; $C_5$-$C_7$ and said second electrical command $C_2$; $C_4$; $C_8$;

number of said electrical commands $C_1$-$C_8$; and distance in time between said electrical commands $C_1$-$C_8$.

In this way, it is possible to modulate the evolution of the instantaneous flow rate between the various injections by varying the amplitude and/or the duration and/or the number of the substantially constant levels of flow rate that it is desired to approximate.

From the foregoing description it is evident that the method for controlling fuel injection enables injection of an instantaneous flow-rate that approximates in an optimal way the flow-rate curve of a stepwise type and that is obtained in a relatively simple way. In fact, the control of injection according to the method described above does not require calibration of mechanical components and/or injectors built in a dedicated way. In addition, it is possible to vary easily the evolution of the flow-rate injected between one injection and the next so as to approximate as closely as possible the desired flow-rate curve and optimize the efficiency of the engine according to the specific point of operation of the engine itself.

From the above description it is evident that modifications and variations may be made to the injection system and to the control method described without thereby departing by the sphere of protection of the present invention. In particular, the control method could be performed with injectors that differ from the electroinjector 1 illustrated by way of example, but in which the displacement of the open/close needle element of the nozzle is always obtained as a function of the pressure of supply of the fuel and is repeatable in response to given electrical commands. In turn, the device 8 can be constituted by a piezoelectric actuator, instead of by an electromagnet.

Furthermore, as already mentioned, the diameter of sealing $D_2$ between the conical tip 7*b* of the needle 7 and the conical tip 5*b* of the nozzle 5 may not coincide with the internal diameter of the annular shoulder 7*a*, for example on account of a different geometry of the bottom portion of the needle 7. Finally, the needle 7 can be displaced during lifting in one and the same injection for a number of times and/or by amounts different from the ones indicated by way of example.

The invention claimed is:

1. A pressurized fuel-injection system for an internal-combustion engine, comprising at least one electroinjector (1) for fuel injection and an electroactuator device (8) for a metering valve (16), said electroinjector (1) comprising an injection nozzle (5) in communication with an injection chamber (6), and a needle (7) mobile for an opening stroke under the action of the pressure of the fuel of said injection chamber (6) against an active surface of said needle (7), said device (8) comprising a rod (14), which is engaged with said needle (7) and has a portion (14*a*) normally pushed by the pressure of said fuel in a control chamber (15) associated to said metering valve (16), said needle (7) being normally held in the position for closing said nozzle (5), said control chamber (15) being equipped with an inlet duct (18) having a pre-set diameter ($D_4$) and an outlet passage (24) having a diameter ($D_5$), said outlet passage (24) being controlled by said metering valve (16); said device (8) being actuated by an electrical control unit designed to issue at least one first electrical command ($C_1$; $C_3$; $C_5$-$C_7$) and at least one second electrical command ($C_2$; $C_4$; $C_8$); said fuel-injection system being characterized in that a ratio ($D_5/D_4$) between the diameter ($D_5$) of said outlet passage (24) and the diameter ($D_4$) of said inlet duct (18) is such as to determine a certain rate of displacement of said needle (7), said first electrical command ($C_1$; $C_3$; $C_5$-$C_7$) and said second electrical command ($C_2$; $C_4$; $C_8$) being close to one another so as to cause a displacement of said needle (7) with a profile of motion (P) without any discontinuities in time.

2. An injection system according to claim 1, in which said active surface is defined by an external diameter ($D_1$) of said needle (7) and by an internal diameter ($D_2$) of sealing between said needle (7) with said nozzle (5), and said portion (14*a*) of said rod (14) has a diameter ($D_3$); said system being characterized in that the ratio ($D_3/D_1$) between the diameter ($D_3$) of said portion (14*a*) and the external diameter ($D_1$) of said active surface and the ratio ($D_1/D_2$) between said external diameter ($D_1$) and said internal diameter ($D_2$) of said active surface are chosen so as to contribute to determining said certain rate of displacement.

3. The injection system according to claim 2, characterized in that said signals ($C_1$-$C_8$) are such as to cause said needle (7) to perform a first displacement ($A_1$; $A_3$; $A_5$-$A_7$) and, respectively, a second displacement ($A_2$; $A_4$; $A_8$) in opening, to control, respectively, a pre-injection of said fuel and a main injection, which depends upon the operating conditions of the engine, so that said main injection starts substantially before the end of said pre-injection.

4. The injection system according to claim 3, characterized in that the ratio ($D_5/D_4$) between the diameter ($D_5$) of said outlet passage (24) and the diameter ($D_4$) of said inlet duct (18) is comprised between 0.7 and 1.4, and the ratio ($D_3/D_1$) between the diameter ($D_3$) of said portion (14*a*) of the rod (14) and the external diameter ($D_1$) of said active surface (7*a*), is comprised between 1.05 and 1.2; the ratio ($D_1/D_2$) between the diameters of said active surface (7*a*) being comprised between 1.85 and 2.35, elastic means being provided for exerting on said needle (7*a*) an action supplementary to that of said rod (14).

5. The injection system according to claim 4, characterized in that the pressure of said fuel in said chambers (6, 15) is comprised between 1200 bar and 1800 bar, the diameter ($D_5$) of said outlet passage (24) being comprised between 0.22 and 0.35 mm, the external diameter ($D_1$) of the active surface of said needle (7) being comprised between 3.2 and 4.8 mm.

6. The injection system according to claim 3, characterized in that said second electrical command ($C_2$) is issued at an instant ($T_2$) such as to start said second opening displacement ($A_2$) at an instant ($TQ_1$) when said needle (7) is displacing along the corresponding closing stroke ($B_1$).

7. The injection system according to claim 3, characterized in that said first electrical command ($C_1$) and said second electrical command ($C_2$) are issued in such a way as to reach, at the end of said first opening displacement ($A_1$) and said second opening displacement ($A_2$), a first degree of opening ($H_1$) and, respectively, a second degree of opening ($H_2$) of said nozzle (5), said degrees of opening ($H_1$, $H_2$) being different from one another.

8. The injection system according to claim 6, characterized in that said first electrical command ($C_1$) is issued before said second electrical command ($C_2$) and so that said second degree of opening ($H_2$) is greater or smaller than said first degree of opening ($H_1$).

9. The injection system according to claim 8, characterized in that said second electrical command ($C_2$) is issued at an instant ($T_2$) in which said first electrical command ($C_1$) is other than zero.

10. The injection system according to claim 3, characterized in that said second electrical command ($C_4$) is issued at an instant ($T_4$) such as to start said second opening displacement ($A_4$) when said needle (7) has just reached the end ($Q_3$) of the corresponding closing stroke ($B_3$).

11. The system according to claim 3, characterized in that said pre-injection is caused by a plurality of electrical commands ($C_5$-$C_7$) sent consecutively to said device (8) and sufficiently close to one another and to said second electrical command ($C_8$) to displace said needle (7) with a profile of motion (P") without any discontinuities in time and such as to cause said needle (7) to perform a corresponding plurality of displacements in opening ($A_5$-$A_7$) before said second displacement in opening ($A_8$).

12. The injection system according to claim 11, characterized in that said plurality of electrical commands ($C_5$-$C_7$) is issued in such a way as to enable, at the end of said corresponding plurality of displacements in opening ($A_5$-$A_7$), respective degrees of opening ($H_5$-$H_7$) to be reached smaller than the degree of opening ($H_8$) caused by said second electrical command ($C_8$).

13. The injection system according to claim 12, characterized in that said plurality of electrical commands ($C_5$-$C_7$) is issued so that the respective degrees of opening ($H_5$-$H_7$) will be the same as one another.

14. A method for controlling injection of fuel in an internal-combustion engine provided with an electroinjector (1), which comprises:

an electroactuator device (8); and an atomizer comprising an injection nozzle (5) and a needle (7) mobile along an opening stroke and a closing stroke for opening/closing said nozzle (5) under the control of said device (8);

the electroinjector (1) performing the metering of the fuel by means of modulation in time of the opening stroke of the needle (7), said opening stroke being controlled by a rod (14) pushed by the pressure of said fuel in a control chamber (15), in such a way as to keep normally said needle (7) in the position for closing said nozzle (5); and said control chamber (15) being provided with an inlet duct (18) having a pre-set diameter ($D_4$) and with an outlet passage (24) having a diameter ($D_5$) and controlled by a control valve (16);

the method comprising:

choosing a ratio of the diameters ($D_5/D_4$) of said outlet passage (24) and of said inlet duct (18) so as to determine a certain rate of displacement of said needle (7);

providing to said device (8) at least one first electrical command ($C_1$; $C_3$; $C_5$-$C_7$) and one second electrical command ($C_2$; $C_4$; $C_8$) to govern corresponding displacements of opening of said needle (7); and timing said first electrical command ($C_1$; $C_3$; $C_5$-$C_7$) and said second electrical command ($C_2$; $C_4$; $C_8$) so that they are sufficiently close to one another to cause a displacement of said needle (7) with a profile of motion (P) without any discontinuities in time.

15. The method according to claim 14, in which said active surface has an external diameter ($D_1$) of said needle and an internal diameter ($D_2$) of sealing between a conical tip (7*b*) of said needle (7) and a conical tip (5*a*) of said nozzle (5), and said portion (14*a*) of said rod (14) has a diameter ($D_3$), said method being characterized in that the ratio ($D_3/D_1$) between the diameter ($D_3$) of said portion (14*a*) and the external diameter ($D_1$) of said active surface (7*a*) and the ratio ($D_1/D_2$) between said external diameter ($D_1$) and said internal diameter ($D_2$) of said active surface (7*a*) are chosen in such a way as to contribute to determining said certain rate of displacement.

16. The method according to claim 15, characterized in that said signals ($C_1$-$C_8$) are chosen so as to cause said needle (7) to perform a first displacement ($A_1$; $A_3$; $A_5$-$A_7$) and, respectively, a second displacement ($A_2$; $A_4$; $A_8$) in opening for controlling, respectively, a pre-injection of said fuel and a main injection, which depends upon the operating conditions of the engine, so that said main injection starts substantially prior to the end of said pre-injection.

17. The method of injection according to claim 16, characterized in that the ratio ($D_5/D_4$) between the diameter ($D_5$) of said outlet passage (24) and the diameter ($D_4$) of said inlet duct (18) is chosen in the range comprised between 0.7 and 1.4, and the ratio ($D_3/D_1$) between the diameter ($D_3$) of said portion (14*a*) of the rod (14) and the external diameter ($D_1$) of said active surface is chosen in the range comprised between 1.05 and 1.2; the ratio ($D_1/D_2$) between the external diameter ($D_1$) and the internal diameter ($D_2$) of said active surface being comprised between 1.85 and 2.35.

18. The method according to claim 17, characterized in that the pressure of said fuel in said chambers (6, 15) is chosen in the range comprised between 1200 bar and 1800 bar, and the diameter ($D_5$) of said outlet passage (24) is chosen in the range comprised between 0.22 and 0.35 mm, and the diameter ($D_1$) of the active surface (7*a*) of said needle (7) is chosen in the range comprised between 3.2 and 4.8 mm.

19. The method according to claim 14, characterized in that said second electrical command ($C_2$) is issued at an instant such as to start said second opening displacement ($A_2$) when said needle (7) is displacing along said closing stroke ($B_1$).

20. The method according to claim 19, characterized in that said first electrical command ($C_1$) and said second electrical command ($C_2$) are issued in such a way as to reach, at the end of said first opening displacement ($A_1$) and said second opening displacement ($A_2$), a first degree of opening ($H_1$) and, respectively, a second degree of opening ($H_2$) of said nozzle (5), said degrees of opening being different from one another.

21. The method according to claim 20, characterized in that said first electrical command ($C_1$) is issued before said second electrical command ($C_2$) and so that said second degree of opening ($H_2$) is greater or smaller than said first degree of opening ($H_1$).

22. The method according to claim 21, characterized in that said second electrical command ($C_2$) is issued at an instant ($T_2$) in which said first electrical command ($C_1$) is other than zero.

23. The method according to claim 14, characterized in that said second electrical command ($C_4$) is issued at an instant ($T_4$) such as to start said second opening displacement ($A_4$) when said needle (7) has just reached the end ($Q_3$) of the corresponding closing stroke ($B_3$).

24. The method according to claim 16, characterized in that said pre-injection is caused by a plurality of electrical commands ($C_5$-$C_7$) sent consecutively to said device (8) and sufficiently close to one another and to said second electrical command ($C_8$) so as to displace said needle (7) with a profile of motion (P") without any discontinuities in time and such as to cause said needle (7) to perform a corresponding plurality of displacements in opening ($A_5$-$A_7$) before said second displacement in opening ($A_8$).

25. The method according to claim 24, characterized in that said plurality of electrical commands ($C_5$-$C_7$) is issued in such a way as to enable, at the end of said corresponding plurality of displacements in opening ($A_5$-$A_7$), respective degrees of opening ($H_5$-$H_7$) to be reached greater or smaller than the degree of opening ($H_8$) caused by said second electrical command ($C_8$).

26. The method according to claim 25, characterized in that said plurality of electrical commands ($C_5$-$C_7$) is issued so that the respective degrees of opening ($H_5$-$H_7$) will be equal to one another.

27. The method according to claim 25, characterized in that said plurality of electrical commands ($C_5$-$C_7$) is issued so that the respective degrees of opening ($H_5$-$H_7$) will be different from one another.

28. The method according to claim 14, characterized in that, for at least one injection, at least one between the following quantities is determined or varied as a function of operating parameters of said engine:

duration of at least one between said first electrical command ($C_1$; $C_3$; $C_5$-$C_7$) and said second electrical command ($C_2$; $C_4$; $C_8$);

number of said electrical commands ($C_1$-$C_8$); and distance in time between said electrical commands ($C_1$-$C_8$).

29. A pressurized fuel-injection system for an internal-combustion engine, comprising at least one electroinjector for fuel injection and an electroactuator device for a metering valve, said electroinjector comprising an injection nozzle in communication with an injection chamber, and a needle mobile for an opening stroke under the action of the pressure of the fuel of said injection chamber against an active surface of said needle, said device comprising a rod, which is engaged with said needle and has a portion normally pushed by the pressure of said fuel in a control chamber associated to said metering valve, said needle being normally held in the position for closing said nozzle, the pressure of said fuel in said chambers being comprised between 1200 bar and 1800 bar, said control chamber being equipped with an inlet duct having a pre-set diameter ($D_4$) and an outlet passage having a diameter ($D_5$), said outlet passage being controlled by said metering valve; said active surface being defined by an external diameter ($D_1$) of said needle and by an internal diameter ($D_2$) of sealing between said needle with said nozzle; said portion of said rod having a diameter ($D_3$); elastic means being provided for exerting on said needle an action supplementary to that of said rod; said device being actuated by an electrical control unit designed to issue at least one first electrical command ($C_1$; $C_3$; $C_5$-$C_7$) and at least one second electrical command ($C_2$; $C_4$; $C_8$); said fuel-injection system being characterized in that a ratio ($D_5/D_4$) between the diameter ($D_5$) of said outlet passage and the diameter ($D_4$) of said inlet duct is comprised between 0.7 and 1.4 to define a predetermined rate of reduction of the pressure in said control chamber, the ratio ($D_3/D_1$) between the diameter ($D_3$) of said portion of the rod and the external diameter ($D_1$) of said active surface, being comprised between 1.05 and 1.2, and the ratio ($D_1/D_2$) between the diameters of said active surface being comprised between 1.85 and 2.35 to define a predetermined rate of displacement of said needle, said first electrical command ($C_1$; $C_3$; $C_5$-$C_7$) and said second electrical command ($C_2$; $C_4$; $C_8$) being close to one another as a function of said delay and said rate of displacement so as to cause a displacement of said needle with a profile of motion (P) without any discontinuities in time.

30. A method for controlling injection of fuel in an internal-combustion engine provided with an electroinjector, which comprises:

an electroactuator device; and an atomizer comprising an injection nozzle and a needle mobile along an opening stroke and a closing stroke for opening/closing said nozzle under the control of said device;

the electroinjector performing the metering of the fuel by means of modulation in time of the opening stroke of the needle under the action of the pressure of the fuel of an injection chamber against an active surface of said needle;

said opening stroke being controlled by a rod having a portion pushed by the pressure of said fuel in a control chamber, in such a way as to keep normally said needle in the position for closing said nozzle;

said control chamber being provided with an inlet duct having a pre-set diameter ($D_4$) and with an outlet passage having a diameter ($D_5$) and controlled by a control valve; and said active surface having an external diameter ($D_1$) of said needle and an internal diameter ($D_2$) of sealing between a conical tip of said needle and a conical tip of said nozzle, and said portion of said rod having a diameter ($D_3$), the method being characterized in that:

providing a pressure of said fuel in said chambers is chosen in the range comprised between 1200 bar and 1800 bar;

defining a predetermined rate of reduction of the pressure in sad control chamber by providing a ratio of the diameters ($D_5/D_4$) between the diameter ($D_5$) of said outlet passage and the diameter ($D_4$) of said inlet duct in the range comprised between 0.7 and 1.4;

defining a predetermined rate of displacement of said needle by providing the ratio ($D_3/D_1$) between the diameter ($D_3$) of said portion of the rod and the external diameter ($D_1$) of said active surface being chosen in the range comprised between 1.05 and 1.2, the ratio ($D_1/D_2$) between the external diameter ($D_1$) and the internal diameter ($D_2$) of said active surface being comprised between 1.85 and 2.35 to;

issuing to said device at least one first electrical command ($C_1$; $C_3$; $C_5$-$C_7$) and one second electrical command ($C_2$; $C_4$; $C_8$) to govern corresponding rate of displacements of opening of said needle; and timing said first electrical command ($C_1$; $C_3$; $C_5$-$C_7$) and said second electrical command ($C_2$; $C_4$; $C_8$) so that they are sufficiently close to one another as a function of said delay and said rate of displacement so as to cause a displacement of said needle with a profile of motion (P) without any discontinuities in time.

* * * * *